US006183282B1

(12) United States Patent
Okabe

(10) Patent No.: US 6,183,282 B1
(45) **Date of Patent: *Feb. 6, 2001**

(54) LEVER FITTING TYPE CONNECTOR

(75) Inventor: Toshiaki Okabe, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/112,340

(22) Filed: Jul. 9, 1998

(30) Foreign Application Priority Data

Jul. 9, 1997 (JP) ..... 9-184059

(51) Int. Cl.[7] ..... H01R 13/62
(52) U.S. Cl. ..... 439/310; 439/372
(58) Field of Search ..... 439/372, 310, 439/152–160

(56) References Cited

U.S. PATENT DOCUMENTS 4,586,771 * 5/1986 Kraemer et al. ..... 439/310
4,981,440 * 1/1991 Werner et al. ..... 439/372
5,499,926 * 3/1996 Akeda ..... 439/372
5,681,175 * 10/1997 Busse et al. ..... 439/372

FOREIGN PATENT DOCUMENTS 5-182716 7/1993 (JP) .
6-68933 3/1994 (JP) .
6-251826 9/1994 (JP) .
6-302353 10/1994 (JP) .

* cited by examiner

*Primary Examiner*—Hien Vu
(74) *Attorney, Agent, or Firm*—Sughrue, Mion, Zinn, Macpeak & Seas, PLLC

(57) ABSTRACT

A lever fitting type connector including a lever having a lever body composed of lever walls, protruding portions and an operating portion, guide ribs provided in a connector body, guide grooves provided in the guide ribs, the protruding portions of the lever being inserted into and guided by the guide grooves, protrusions provided on inner walls of the guide grooves, the protrusions being engaged with the protruding portions so that the lever walls can be temporarily fixed to a temporarily fixing position with respect to the connector body, and tapered surfaces used as an engagement release portion provided in the hood portion, the engagement release portion releasing an engagement condition of the protruding portions with the protrusions when the connector body is inserted into the hood portion.

3 Claims, 6 Drawing Sheets

LEVER FITTING TYPE CONNECTOR

BACKGROUND OF THE INVENTION

1. Field of the Invention

The present invention relates to a lever fitting type connector in which a male connector and a female connector are fitted to each other by operating a lever.

2. Description of the Related Art

FIG. 8 is a view showing a frame connecting type connector 1 disclosed in Japanese Patent Unexamined Publication No. Hei. 6-251826. This connector 1 includes: a female connector portion 3 provided in a junction box body 2 of an electrical junction box or the like; a male connector 5 which is inserted into and fitted to a hood portion 4 of the female connector portion 3; and a frame 6 for inserting the male connector 5 into the female connector portion 3 so that the male connector 5 can be fitted to the female connector portion 3. The frame 6 includes: a main body 7 in which the male connector 5 is pivotally arranged via a support shaft 5*a*; a turning leg portion 8 protruding from one side of the main body 7; and an operating protrusion 9 protruding from the other side of the main body 7. There is provided a sliding shaft 10 at a forward end portion of the turning leg portion 8. This sliding shaft 10 is inserted into and engaged with a slide groove 12 of a frame support portion 11 provided in the periphery of the female connector portion 3.

As shown in FIG. 9, the sliding shaft 10 is engaged with the slide groove 12, and the operating protrusion 9 is pressed, so that the frame 6 is turned around the sliding shaft 10 in the direction of arrow "a". Due to the foregoing, the male connector 5 can be inserted into and fitted to the female connector portion 3. In order to disconnect the male connector 5 from the female connector portion 3, the operating protrusion 9 is pressed in the opposite direction, so that the frame 6 can be turned in the direction opposite to that of arrow "a". In this way, the male connector 5 can be disconnected from the hood portion 4 of the female connector portion 3.

In this case, the sliding shaft 10 becomes a fulcrum, and the operating protrusion 9 becomes a point of force. Due to the foregoing, a supporting portion at which the male connector 5 is rotatably supported by the frame 6 becomes a point of action. Therefore, it is possible to fit the male connector 5 to the female connector portion 3 even when a low intensity of force is given. Accordingly, an intensity of force can be reduced when the male connector 5 is fitted to the female connector portion 3.

In the above connector 1, the main body 7 is rotatably supported by the male connector 5 via the support shaft 5*a*. Therefore, when the male connector 5 is first fitted to the female connector portion 3, the frame 6 is rickety. Therefore, the frame 6 gets in the way of fitting operation. Accordingly, the efficiency of fitting work to fit the male connector to the female connector portion is deteriorated. Further, when the sliding shaft 10 of the frame 6 is inserted into the slide groove 12, the male connector 5 becomes rickety, and the efficiency of fitting work is deteriorated.

In order to solve the above problems, it is conceivable to take the following countermeasure. A temporarily fixing protrusion is formed on the inner wall of the frame 6, and a temporarily fixing hole is formed in the outer wall of the male connector 5, into which the temporarily fixing protrusion is inserted for engagement. In this way, the frame 6 is temporarily fixed to the male connector 5.

However, when the temporarily fixing protrusion is disconnected from the temporarily fixing hole, the inner wall of the frame is bent outward. Accordingly, there is a possibility that the frame 6 is disconnected from the support shaft 5*a*. In order to prevent the frame 6 from being disconnected from the support shaft 5*a*, it is conceivable that a cover for preventing the disconnection is arranged outside the frame. In this case, however, the size of the overall connector is increased.

SUMMARY OF THE INVENTION

It is an object of the present invention to provide a lever fitting type connector in which a lever can be temporarily fixed to a connector body while an increase in the size of the connector is suppressed, and the temporarily fixing condition of the lever to the connector body can be easily released, so that the working efficiency of fitting operation can be enhanced.

In order to accomplish the above object, the present invention provides a lever fitting type connector comprising: a female connector portion including a hood portion integrated with a housing in which terminals are accommodated; a male connector portion including a connector body in which mating terminals to be connected with the terminals are accommodated, the connector body engaging with the hood portion so that the terminals are connected with the mating terminals; a lever for inserting the connector body into the hood portion so as to fit the connector body to the hood portion, the lever including a lever body composed of a lever wall rotatably supported by the connector body, a protruding portion provided on one side of the lever wall, the protruding portion engaging with the hood portion when the hood portion is fitted to the connector body, and an operating portion provided on the other side of the lever wall, the operating portion inserting the connector body into the hood portion so that the connector body is fitted to the hood portion when the lever wall is turned around a portion at which the protruding portion is engaged with the hood portion; a guide rib provided in the connector body; a guide groove provided in the guide rib, the protruding portion of the lever being inserted into and guided by the guide groove; a projection provided on an inner wall of the guide groove, the projection being engaged with the protruding portion of the lever so that the lever wall is temporarily fixed to a temporarily fixing position of the connector body; and an engagement release portion provided in the hood portion, the engagement release portion releasing an engagement condition of the protruding portion of the lever with the projection when the connector body is inserted into the hood portion.

DETAILED DESCRIPTION OF THE PREFERRED EMBODIMENT

Figure 1:
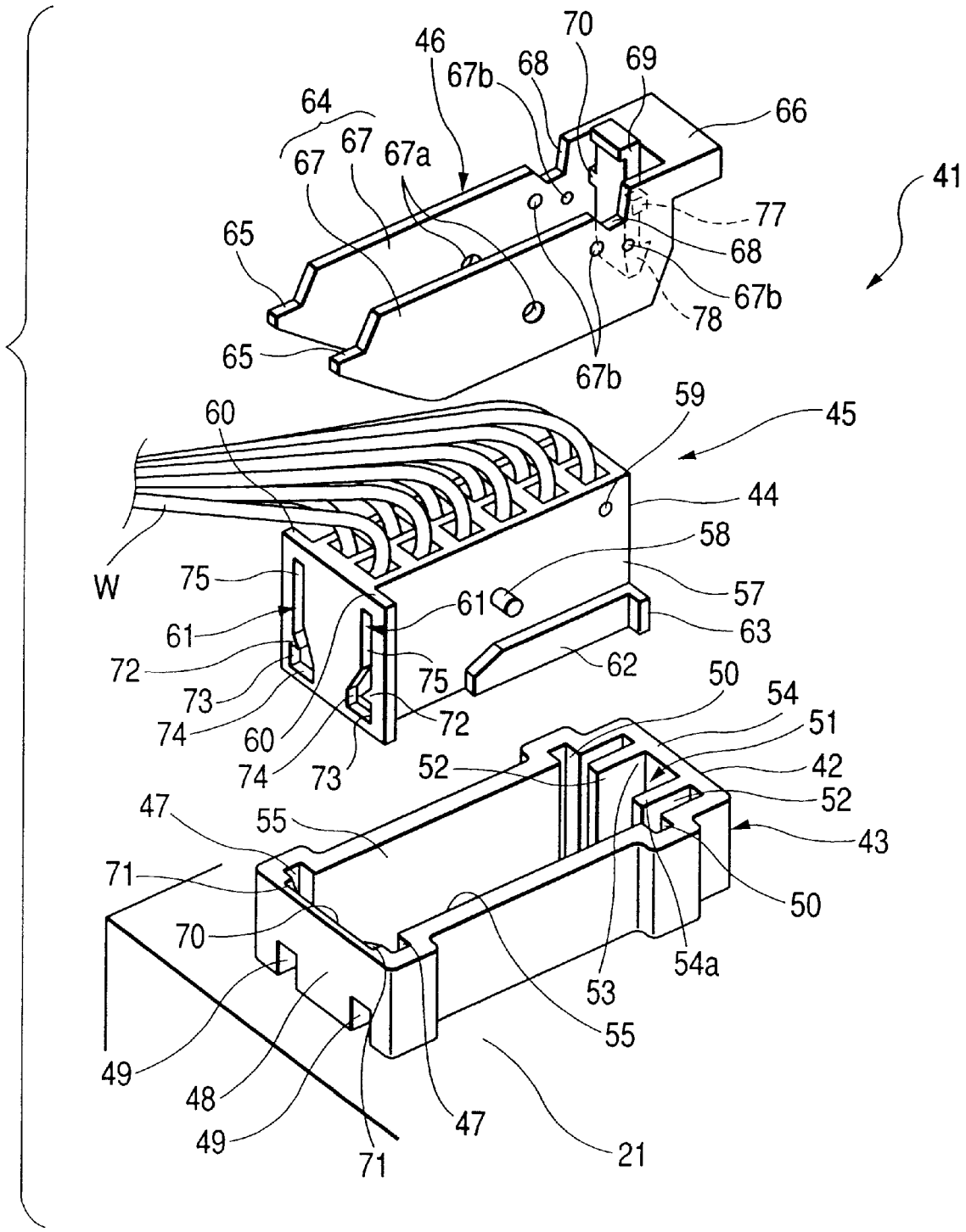
FIG. 1 is an exploded perspective view showing an embodiment of the lever fitting type connector according to the present invention.
Figure 2:
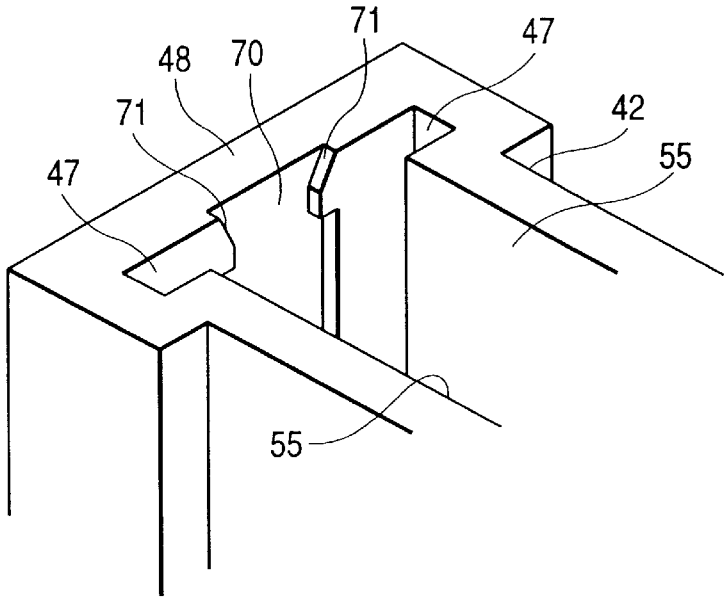
FIG. 2 is a partially enlarged perspective view of a hood portion of a female connector portion.
Figure 3:
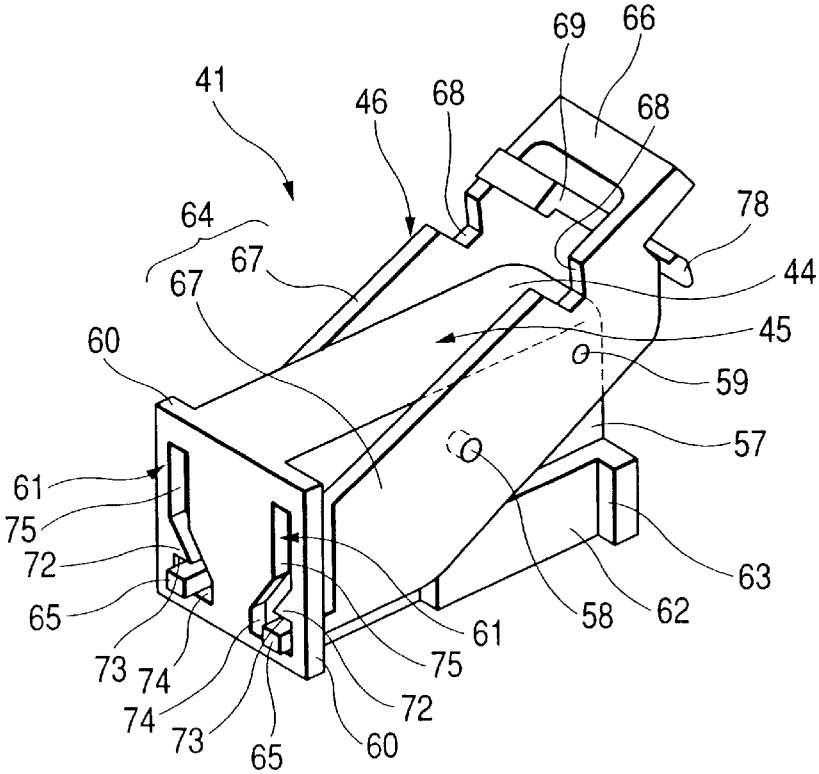
FIG. 3 is a perspective view showing a male connector of the lever fitting type connector of the embodiment and a lever attached to the outside of this male connector.
Figure 4:
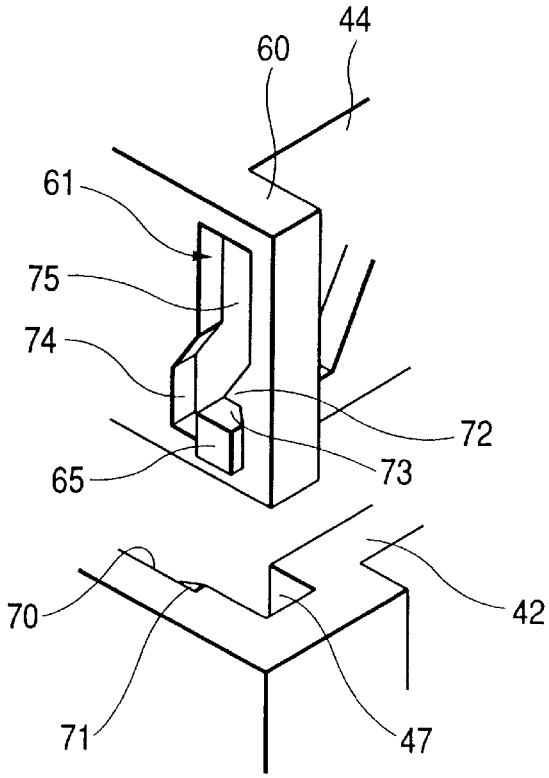
FIG. 4 is a perspective view showing a relation among a rib guide groove provided in the hood portion, a rib provided in the connector body, and a protruding of the lever inserted into the long hole formed in the rib.
Figure 5:
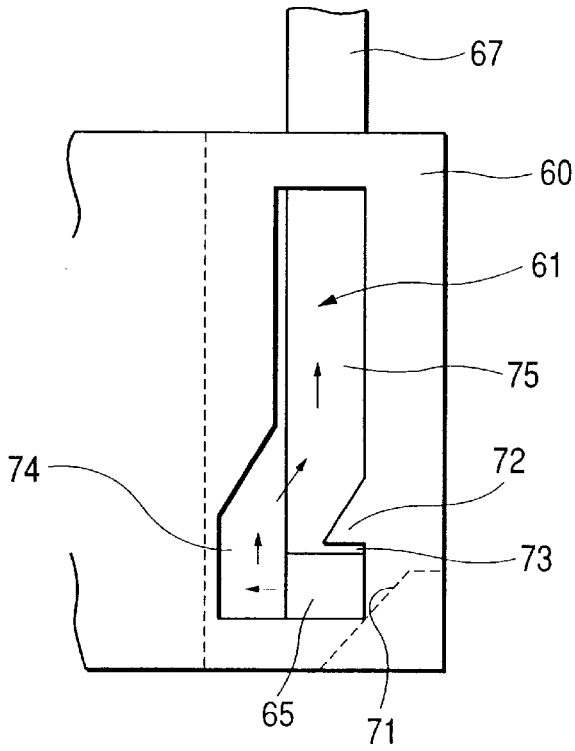
FIG. 5 is a front view showing a relation between the protruding portion of the lever wall and the long hole.

Referring to the accompanying drawings, an embodiment of the lever fitting type connector of the present invention will be explained below. FIG. 1 is a perspective view of a lever fitting type connector 41, which will be referred to as "connector" in this specification hereinafter. FIG. 2 is a partially enlarged perspective view of a hood portion 42. FIG. 3 is a perspective view showing a state in which a lever 46 is attached to the outside of a connector body 44.

As shown in FIG. 1, the connector 41 of this embodiment includes: a female connector portion 43, the hood portion 42 of which is formed integrally with a housing 21 of an upper cover of an electrical junction box; a male connector portion 45 having a connector body 44 to be inserted into and fitted to a hood portion 42 of the female connector portion 43; and a lever 46 attached to the outside of the connector body 44 of the male connector portion 45, wherein the connector body 44 is inserted into the hood portion 42 of the female connector portion 43, the lever (46) being used to secure the male connector portion (45) to the female connector portion 43.

The housing 21 of the female connector portion 43 accommodates a terminal portion of the bus bar. The male terminal portion of the terminal portion protrudes into the hood portion 42. On one side of the hood portion 42, there are provided rib guide grooves (guide support grooves) 47, 47 protruding onto both sides. Inside an outer wall 48 composing the rib guide grooves 47, 47, there is provided a recessed wall 70, which is recessed outside, as shown in FIG. 2. At the upper edge of this recessed wall 70, there are provided tapered surfaces 71, 71 which are used as an engagement release portion. Further, on the outer wall 48, there are provided a pair of cutout portions 49, 49. Ribs 60, 60 of the connector body 44, which will be described later, are inserted into the rib guide grooves 47, 47. Protruding portions 65, 65 of the lever walls 67, 67, which will be described later, are respectively inserted into and engaged with the cutout portions 49, 49.

On the other side of the hood portion 42, there are provided guide grooves 50, 50 protruding onto both sides. Guide ribs 63, 63, which are protruding from the connector body 44, are inserted into these guide grooves 50, 50. There is provided a lever lock portion 51 on the side which is closer to the end of the hood portion 42 than the guide grooves 50, 50. In this lever lock portion 51, there are provided a pair of guide walls 52, 52 protruding inside the hood portion 42. Between these guide walls 52, 52, there is formed a lock piece inserting space 53. Further, on the outer wall 54 from which the guide walls 52, 52 are protruded, there is provided a cutout portion 54*a*. This cutout portion 54*a* is engaged with a lock piece 69 of the lever 46 inserted into the lock piece inserting space 53.

Figure 6A:
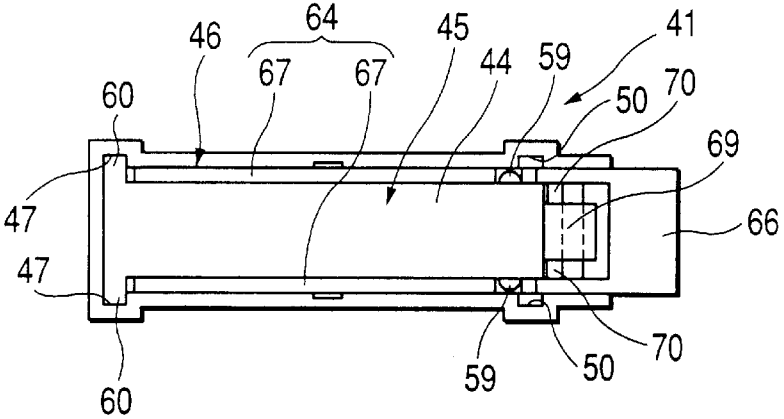
FIGS. 6(*a*) to 6(*c*) are views showing the lever fitting type connector, wherein FIG. 6(*a*) is a plan view showing a condition in which the male connector is fitted to the female connector portion, FIG. 6(*b*) is a cross-sectional view showing the inside, and FIG. 6(*c*) is a side view.
Figure 6B:
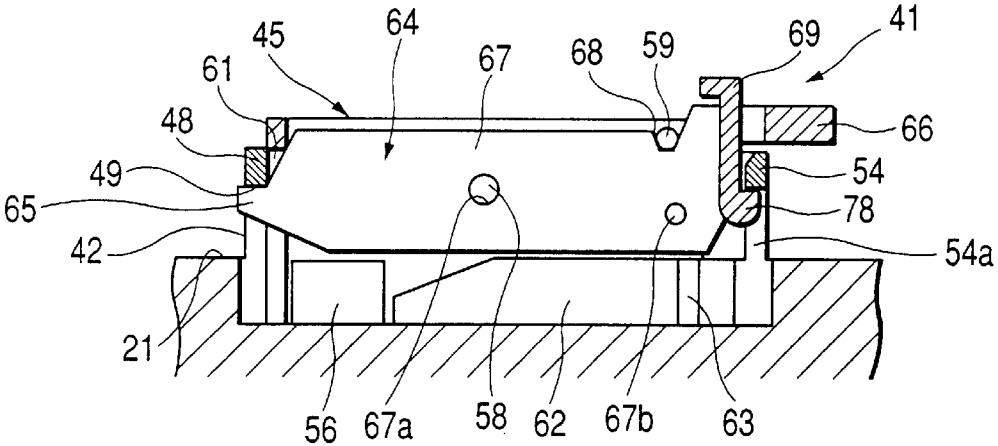

As shown in FIG. 6(b), on the inner walls 55, 55 of the hood portion 42, there are provided padding portions 56, 56 used for engaging the protruding portion on the side of the rib guide grooves 47, 47. The connector body 44 of the male connector 45 is inserted into and fitted to the hood portion 42 when the lever 46 is operated, and a female terminal (not shown) accommodated in the connector body 44 is electrically communicated with the male terminal portion by contact.

In the connector body 44 of the male connector portion 45, there are provided a plurality of terminal accommodating chambers. In these terminal accommodating chambers, female terminals are respectively accommodated. The mating male terminals are inserted from one side of the terminal accommodating chambers, and electrical wires W having the female terminals connected to the ends thereof are drawn out from the other side of the terminal accommodating chambers.

At the centers of both side walls 57, 57 of the connector body 44, there are provided columnar boss portions 58, 58 which are protruding from the side walls. In FIG. 1, only one side wall 57 is shown. With respect to these boss portions 58, 58, there are provided temporarily fixing protruding portions 59, 59 which are smaller than the boss portions 58, 58. The boss portions 58, 58 are inserted into rotary holes 67*a*, 67*a* provided in lever walls 67, 67 which will be described later. The temporarily fixing protruding portions 59, 59 are inserted into and engaged with the temporarily fixing holes 67*b*, 67*b* provided in the lever walls 67, 67.

On one side of the side walls 57, 57 of the connector body 44, there are provided ribs 60, 60. When the connector body 44 is inserted into and fitted to the hood portion 42, these ribs 60, 60 are respectively inserted into the rib guide grooves 47, 47. In the ribs 60, 60, there are provided long holes (guide grooves) 61, 61 which are arranged in the fitting direction of the connector body 44 to the hood portion 42. In the long hole 61, a projection 72 is protruded from the inner wall of the connector body 44 on the fitting surface side. The lower side of this projection 72 is an engaging groove 73. When the protruding portion 65 of the lever wall 67 is inserted into this engaging groove 73, the protruding portion of the lever 65 is engaged with the projection 72, so that the protruding portion of the lever 65 can be held in the engaging groove 73, and the lever wall 67 can be held at a temporarily fixing position with respect to the connector body 44.

There is provided an engaging release groove 74 adjacent to the engaging groove 73, wherein the engaging release groove 74 is formed continuously to the engaging groove 73. When the protruding portion of the lever 65 is moved from the engaging groove 73 into the release engaging groove 74, the protruding portion of the lever 65 can be released from the projection 72. Further, there is provided a guide groove 75 which is formed continuously to the release engaging groove 74. In this guide groove 75, the protruding portion of the lever 65 is guided and held when it is rotated around the engaging portion with the cutout portion 49.

On both side walls 57, 57 of the connector body 44, there are respectively provided padding portions 62, 62 used for preventing the occurrence of a rickety condition, wherein the padding portions 62, 62 are formed on the lower side of the bosses 58, 58 and on the engaging surface side of the connector body 44. Guide ribs 63, 63 are respectively protruded from the padding portions 62, 62. The lever 46 is attached to the outside of the connector body 44.

Figure 6C:
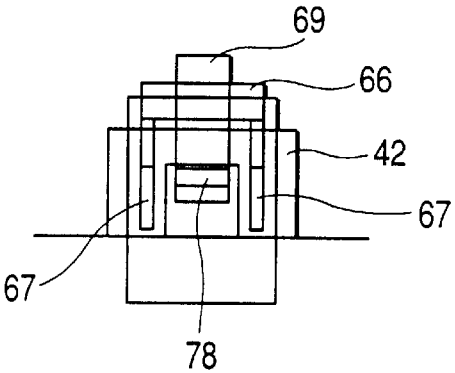

The lever 46 includes: a lever body 64 rotatably supported by the connector body 44 of the male connector portion 45; a protruding portion 65 arranged on one side of the lever body 64, the protruding portion of the lever 65 engaging with the hood portion 42 when the connector body 44 is engaged with the hood portion 42; and an operating portion 66 provided on the other side of the lever body 64, the operating portion 66 being capable of making the connector body 44 fit to the hood portion 42 by turning the lever body 64 around the engaging portion of the protruding portion 65 with the hood portion 42. As shown in FIGS. 6(*a*), 6(*b*) and 6(*c*), when the connector body 44 is fitted to the hood portion 42, the lever body 64 is located inside the hood portion 42.

As shown in FIGS. 1 and 3, the lever body 64 is composed of a pair of sheet-shaped lever walls 67, 67 supported on both side walls 57, 57 of the connector body 44 in such a manner that the pair of sheet-shaped lever walls 67, 67 can be freely rotated on both side walls 57, 57. The protruding portions 65, 65 are respectively formed on one side of these lever walls 67, 67. The pair of lever walls 67, 67 are connected with each other on the other side. Rotary holes 67*a*, 67*a* are formed at the substantial centers of the lever walls 67, 67. When the bosses 58, 58 are inserted into these rotary holes 67*a*, 67*a*, the lever walls 67, 67 are capable of rotating on the surfaces of the side walls 57, 57 of the connector body 44. Further, in the lever walls 67, 67, there are provided holes 67*b*, 67*b* used for the temporary attaching. These holes 67*b*, 67*b* used for the temporary attaching are arranged on the operating portion 66 side of the lever wall 67. Protrusions 59, 59 used for the temporary attaching, which are protruded from the side walls 57, 57 of the connector body 44, are inserted into and engaged with these holes 67*b*, 67*b* used for the temporary attaching. Due to the foregoing, the lever body 64 can be held at the temporarily fixing position with respect to the connector body 44. On the lever walls 67, 67, main engaging recesses 68, 68 are formed on the operating portion 66 side. When the lever 46 is attached to the outside of the connector body 44, the lever walls 67, 67 are located on the padding portions 62, 62 used for preventing the connector from being rickety, and the protruding portions 65, 65 are respectively inserted into the long holes 61, 61 formed in the ribs 60, 60 of the connector body 44.

There is further provided a lock piece 69 between the lever walls 67, 67 on the operating portion 66 side. This lock piece 69 is formed integrally with both side walls of the lever walls 67, 67 via flexible arm portions 77, 77. At the forward end of this lock piece 69, there is provided an engaging protrusion 78 which is engaged with the cutout portion 54*a* provided in the hood portion 42.

As shown in FIG. 6(*b*), when the lever 46 is attached to the outside of the connector body 44 and temporarily fixed, the lever walls 67, 67 are located on the padding portions 62, 62 used for preventing the connector from being rickety, and the protruding portions 65, 65 come into contact with an upper surface of the padding portion 56 used for engaging the protruding portion and are inserted into the long holes 61, 61 at the same time.

The following are explanations of the procedure of fitting the male connector portion 45 to the female connector portion 43 in the above connector 41.

Figure 7A:
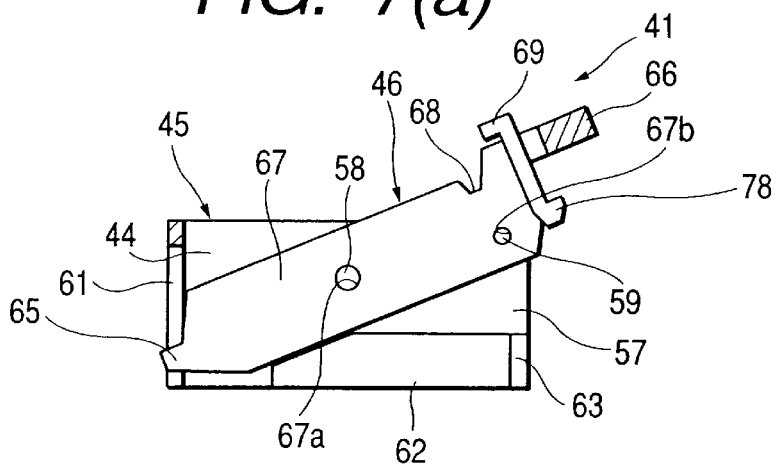
FIGS. 7(*a*) to 7(*c*) are views showing a procedure in which the male connector is fitted to the female connector portion in the lever fitting type connector, wherein FIG. 7(*a*) is a cross-sectional view showing a condition in which the lever is temporarily fixed to a temporarily fixing position with respect to the connector body, FIG. 7(*b*) is a cross-sectional view showing a condition in which the connector body is inserted into the hood portion at the temporarily fixing position, and FIG. 7(*c*) is a cross-sectional view showing a condition in which the connector body is completely inserted into and fitted to the hood portion.
Figure 7B:
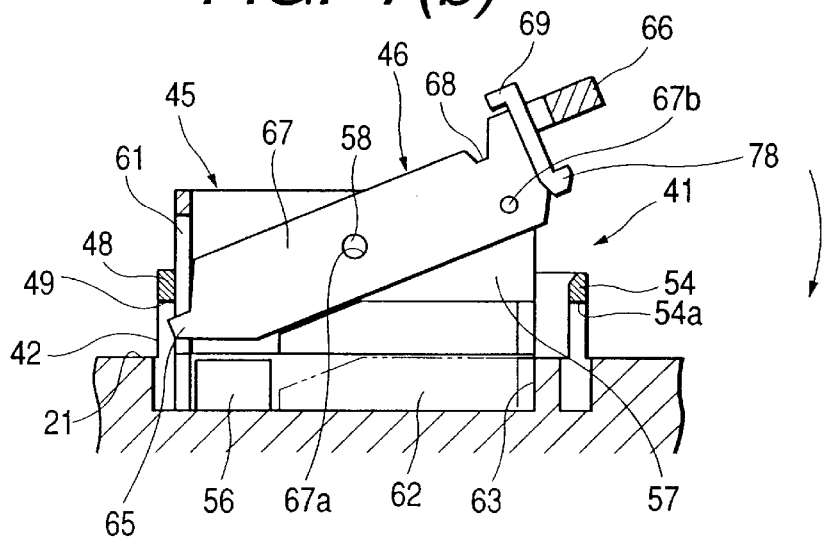
Figure 7C:
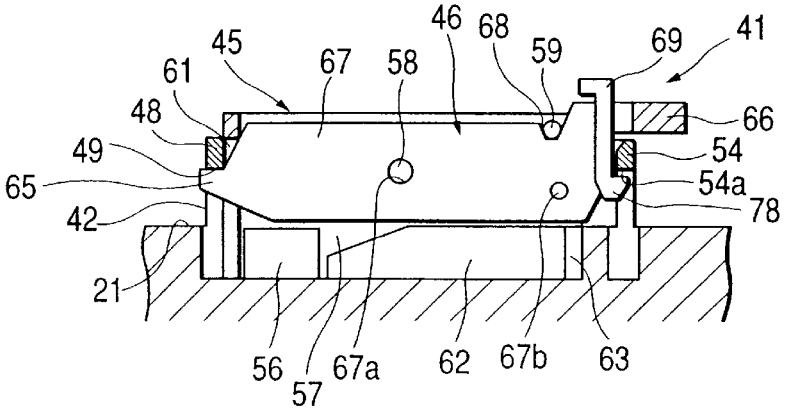
Figure 8:
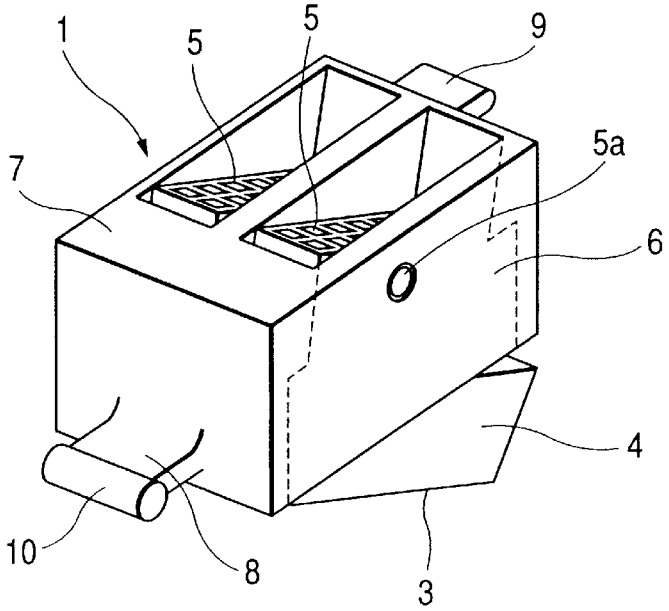
FIG. 8 PRIOR ART
FIG. 8 is a perspective view of a conventional frame connecting type connector.
Figure 9:
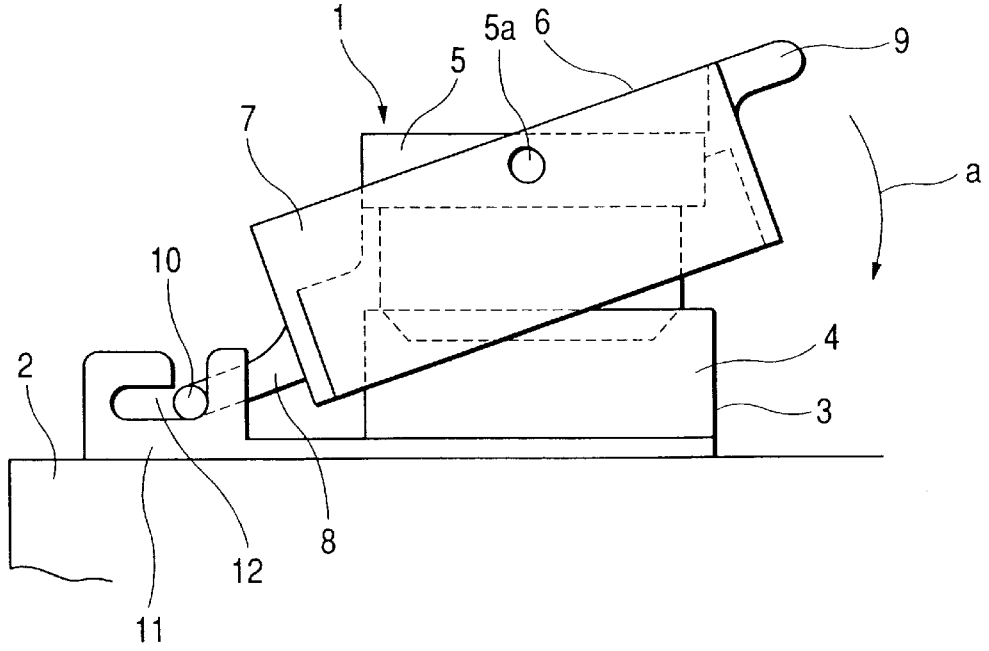
FIG. 9 PRIOR ART
FIG. 9 is a side view showing a method of fitting the male connector portion to the female connector portion in the conventional frame connecting type connector.

As shown in FIGS. 3 and 7(*a*), the lever 46 is attached to the outside of the connector body 44 of the male connector 45 and temporarily fixed to the temporarily fixing position. Under the above condition, the connector body 44 is inserted into the hood portion 42 as shown in FIG. 7(*b*). When the connector body 44 is inserted into the hood portion 2, the ribs 60, 60 are inserted into the rib guide grooves 47, 47, and the forward end portions of the protruding portions 65, 65 come into contact with the tapered surfaces 71, 71. When the connector body 44 is further inserted into the hood portion 42, the protruding portions 65, 65 slide on the tapered surfaces 71, 71, so that the protruding portions of the lever 65, 65 are moved from the engaging grooves 73, 73 to the engaging release grooves 74, 74. Therefore, the protruding portions 65, 65 are released from the engagement with the projections 72, 72. At the same time, the forward end portions of the lever of the protruding portions 65, 65 are inserted into and engaged with the cutout portions 49, 49 of the hood portion 42. In this case, when the lower end surfaces of the protruding portions of the lever 65, 65 come into contact with the padding portions 56, 56 used for engaging the protruding portion provided on the inner wall of the hood portion 42, the protruding portions of the lever 65, 65 can be positioned at the engaging positions with the hood portion 42.

Under the above condition, the operating portion 66 is pressed so that the lever 46 is operated. Due to the foregoing, when the lever walls 67, 67 are slightly rotated around the bosses 58, 58, the protruding portions of the lever 65, 65 come into contact with the inner walls of the cutout portions 49, 49. When the lever 46 is further operated, the protruding portions of the lever 65, 65 are rotated about the engaging portions in which the protruding portions of the lever 65, 65 are engaged with the cutout portions 49, 49. Therefore, the connector body 44 is inserted into and fitted to an inner portion of the hood portion 42. When the connector body 44 has been completely inserted into and fitted to the hood portion 42, the engaging protrusion 78 of the lock piece 69 is engaged with the cutout portion 54*a*. Due to the foregoing, the connector body 44 is completely fitted in the hood portion 42, and the male connector portion 45 is fitted to the female connector portion 43. When the engaging protrusion 78 of the lock piece 69 is engaged with the cutout portion 54*a*, it is possible to prevent the lever 46 from being carelessly turned.

As shown in FIG. 7(*c*), in order to disconnect the connector body 44 from the hood portion 42 in a condition that the connector body 44 is completely fitted to the hood portion 42, the lock piece 69 is bent and the engaging protrusion 78 is disengaged from the cutout portion 54*a*, and then the operating portion 66 is operated, so that the lever walls 67, 67 are rotated in a direction opposite to the above. When the lever walls 67, 67 are rotated, the connector body 44 is disconnected from the hood portion 42 and located at the temporarily fixing position. By lifting up the connector body 44 to an upper portion of the hood portion 42 in the above condition, it is possible to disconnect the connector body 44 from the hood portion 42.

In the connector 41 of this embodiment, the protruding portions 65, 65 of the lever walls 67, 67 can be temporarily fixed when they are engaged with the projections 72 in the long holes 61, 61 of the ribs 60, 60. Therefore, it is unnecessary to provide a cover for preventing the lever walls 67, 67 from being disconnected. Accordingly, while an increase in the size of the connector is prevented, the lever 46 can be temporarily fixed to the connector body 44. Only when the connector body 44 is inserted into the hood portion 42 under the condition that the lever walls 67, 67 are temporarily fixed to the connector body 44, the forward end portions of the protruding portions of the lever 65, 65 come into contact with the tapered surfaces 71, 71 which are the engagement release portion. Therefore, the temporarily fixing condition, in which the lever walls 67, 67 are temporarily fixed to the connector body 44, can be easily released.

In the connector 41 of this embodiment, the protruding portions of the lever 65, 65 can be temporarily fixed at the temporarily fixing position when they are engaged with the projections 72, 72 in the long holes 61, 61. Accordingly, when the connector body 44 is inserted into the hood portion 42, the lever walls 67, 67 do not obstruct the inserting work. Therefore, the working efficiency can be enhanced in the fitting work of the connector.

When the protruding portions of the lever 65, 65 are moved from the engaging grooves 73, 73 into the engaging release grooves 74, 74, the lever walls 67, 67 are bent inward. Accordingly, there is no possibility that the lever walls 67, 67 are disconnected from the side walls 57, 57 of the connector body 44.

In the connector 41 of this embodiment, the lever walls 67, 67 of the lever 46 are turned on both side walls 57, 57 of the connector body 44 and interposed between both side walls 57, 57 of the connector body 44 and the inner walls 55, 55 of the hood portion 42. Therefore, even if the lever walls 67, 67 attempt to bend outward, they are restricted by the inner walls 55, 55 of the hood portion 42. Accordingly, the lever walls 67, 67 are not disconnected from the bosses 58, 58, and the connector body 44 can be positively inserted into and fitted to the hood portion 42. Further, it is possible to reduce an intensity of the operating force when the connector body 44 is inserted into and fitted to the hood portion 42.

In the lever fitting type connector 41 of this embodiment, the plate-shaped lever walls 67, 67 of the lever 46 are interposed between both side walls 57, 57 of the connector body 44 and the inner walls 55, 55 of the hood portion 42 and freely turned on both side walls 57, 57 of the connector body 44. Due to the above structure, a portion of the connector protruding from the hood portion 42 is small. As a result, the size of the overall connector can be reduced, and the occupying space can be decreased.

In addition to the above effects, since the protruding portions 65, 65 are inserted into the long holes 61, 61 of the ribs 60, 60 in this embodiment, even if the lever walls 67, 67 are bent, there is no possibility that the protruding portions 65, 65 are disconnected from the cutout portions 49, 49. Consequently, when the lever 46 is turned, the connector body 44 can be positively inserted into and fitted to the hood portion 42, and the connector body 44 can be positively disconnected from the hood portion 42.

In this embodiment, on the inner walls 55, 55 of the hood portion 42, there are respectively provided padding portions 56, 56 for engaging the protruding portions. Accordingly, the lower end surfaces of the lever walls 67, 67 come into contact with the upper surfaces of the padding portions 56, 56, so that the lever walls 67, 67 can be temporarily positioned. Therefore, the protruding portions 65, 65 can be easily and positively inserted into and engaged with the cutout portions 49, 49. Consequently, only when the lever walls 67, 67 are slightly turned, the protruding portions of the lever 65, 65 can be engaged while the protruding portions of the lever 65, 65 are coming into contact with the inner walls of the cutout portions 49, 49.

In this embodiment, on the side walls 57, 57 of the connector body 44, there are provided padding portions 62 for preventing the connector from being rickety. Therefore, when the connector body 44 is fitted to the hood portion 42, there is no possibility that the connector body 44 becomes rickety in the hood portion 42. As a result, no stress is given to a contacting portion in which the terminal protruding in the hood portion 42 is contacted with the terminal in the connector body 44.

In this embodiment, there is provided the lock piece 69 in the lever 46. The engaging protrusion 78 of this lock piece 69 is engaged with the cutout portion 54*a* provided on the outer wall 54 of the hood portion 42. Due to the foregoing, it is possible to prevent the lever 46 from being carelessly turned.

In this embodiment, there are provided ribs 60, 60 and guide ribs 63, 63 in the connector body 44. Also, there are provided rib guide grooves 47, 47 and guide grooves 50, 50 in the hood portion 42. Due to the above arrangement, the connector body 44 can be guided in the correct fitting direction with respect to the hood portion 42. Therefore, it is possible to conduct a smooth fitting motion.

In the above embodiment, an example is shown in which the female connector portion 43 is provided integrally with the electrical junction box 16. However, it is possible to apply the present invention to a female connector connected with a terminal of the wire harness.

In the above embodiment, the temporarily fixing protrusion 59 is inserted into and engaged with the temporarily fixing hole 67*a* on the lever wall 67. Due to the foregoing, the lever wall 67 is held at the temporarily fixing position with respect to the connector body 44. However, when the protruding portion 65 is engaged with the projection 72 in the long hole 61, it is possible to hold the lever wall 67 at the temporarily fixing position with respect to the connector body 44.

As described above, according to the invention, when the protruding portion of the lever wall is engaged with the protrusion of the guide rib in the guide groove, the temporary fixing can be conducted. Accordingly, it is unnecessary to provide a cover for preventing the lever wall from being disconnected. Therefore, while an increase in the size of the connector is prevented, the lever can be temporarily fixed to the connector body. Further, when the connector body is merely inserted into the hood portion under the condition that the lever wall is temporarily fixed to the connector body, the engaging release portion can easily release a temporarily fixing condition of the lever wall with respect to the connector body.

What is claimed is:

1. A lever fitting type connector comprising:

a female connector portion having terminals therein and including a hood portion;

a male connector portion including a connector body having terminals therein, said male connector portion being received in said hood portion and mating with said female connector portion;

a lever attached to said connector body for inserting the connector body into the hood portion so as to fit the connector body to the hood portion, said lever including a lever body, said lever body having a lever wall rotatably supported by the connector body, protruding portions provided on one end of the lever wall and being engageable with the hood portion when the hood portion is fitted to the connector body, and an operating portion provided on the other side end of the lever wall for rotating said lever to facilitate insertion of the connector body into the hood portion;

ribs provided in the connector body each having a long hole therein, protruding portions of the lever being inserted into and guided by said long holes;

a projection provided on an inner wall of said long holes and being engageable with the protruding portions to retain said lever in a temporarily locked position; and tappered surfaces provided in the hood portion, said tappered surfaces releasing an engagement condition of the protruding portions with the protrusions when the connector body is inserted into the hood portion to allow said lever to be rotated to an unlocked position.

2. The lever fitting type connector according to claim 1, wherein each of said long holes includes:

an engaging groove in which the protruding portion of the lever is accommodated when the protruding portion of the lever is engaged with the projection; an engaging release groove extending from the engaging groove, the protruding portion of the lever being accommodated in the engaging release groove immediately after the engagement with the projection has been released; and a long hole continuously provided in the engaging release groove, the guide groove guiding and supporting the protruding portion of the lever.

3. A lever fitting type connector according to claim 1 further comprising:

said connector body having said ribs and guide ribs, said hood portion having rib guide grooves and guide grooves, said guide ribs being inserted into said guide grooves and said ribs being inserted into said rib guide grooves to guide said connector body when being inserted into said hood portion.

* * * * *